US010168116B1

(12) United States Patent
Jen

(10) Patent No.: US 10,168,116 B1
(45) Date of Patent: Jan. 1, 2019

(54) SELF-RELEASING MAGAZINE AND FOLLOWER ASSEMBLY THEREOF FOR FIREARMS

(71) Applicant: Strike Industries, Inc., Santa Ana, CA (US)

(72) Inventor: Yihuei Jen, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 15/795,133

(22) Filed: Oct. 26, 2017

(51) Int. Cl.
*F41A 9/67* (2006.01)
*F41A 9/70* (2006.01)

(52) U.S. Cl.
CPC .. *F41A 9/67* (2013.01); *F41A 9/70* (2013.01)

(58) Field of Classification Search
CPC ..... F41A 9/67; F41A 9/65; F41A 9/70
USPC ..... 42/50
See application file for complete search history.

(56) References Cited

U.S. PATENT DOCUMENTS 5,638,626 A * 6/1997 Westrom ..... F41A 9/70 42/18
8,387,296 B2 * 3/2013 Overstreet ..... F41A 17/36 42/50
9,921,016 B1 * 3/2018 Couie ..... F41A 9/83
2013/0167421 A1 * 7/2013 Zheng ..... F41A 9/70 42/50
2015/0121736 A1 * 5/2015 Faifer ..... F41A 9/65 42/49.01
2016/0076841 A1 * 3/2016 Ballard ..... F41A 9/65 42/50
2016/0282071 A1 * 9/2016 Vilardi ..... F41A 9/65

OTHER PUBLICATIONS https://www.thefirearmblog.com/blog/2017/03/23/cobalt-advantage-reloading-system-cars/ (Year: 2017).*

* cited by examiner

*Primary Examiner* — Joshua E Freeman
(74) *Attorney, Agent, or Firm* — Andy M. Han; Han IP PLLC

(57) ABSTRACT

Examples of a self-releasing magazine and a magazine follower assembly thereof for firearms are described. The magazine follower assembly includes a casing and a self-releasing actuator received in the casing. When in use, the magazine follower assembly generally moves along a first axis with respect to the casing between a first position in the magazine when the magazine is fully loaded and a second position in the magazine when the magazine contains no ammunition cartridge. When the magazine follower assembly is at the second position in the magazine, the self-releasing actuator is configured to actuate a magazine release mechanism of the firearm to disengage the magazine from the firearm so that the magazine is detachable from the firearm.

20 Claims, 4 Drawing Sheets

ACTIONS:

1 = STOPPER 110 MOVING TO UP POSITION

2 = MAIN LEVER 130 MOVING TO ACTUATED POSITION

3 = AUTO-RELEASE BUTTON 140 MOVING TO PROTRUDED POSITION

THREE-DIMENSIONAL (3D) CARTESIAN COORDINATE OF DIRECTIONS IN WHICH COMPONENTS CAN MOVE

SELF-RELEASING MAGAZINE AND FOLLOWER ASSEMBLY THEREOF FOR FIREARMS

TECHNICAL FIELD

The present disclosure is generally related to firearms and, more particularly, to a self-releasing magazine and a magazine follower assembly thereof for firearms.

BACKGROUND

Unless otherwise indicated herein, approaches described in this section are not prior art to the claims listed below and are not admitted as prior art by inclusion in this section.

In the context of firearms, a magazine is an ammunition storage and feeding device that is contained within or attached to a firearm. In general, the magazine can be removable or otherwise detachable with respect to the firearm. A magazine typically includes a spring, a spring follower, a magazine body, and a base. The base is used to seal off one distal end of the magazine body leaving the opposite distal end open. One end of the spring is attached to or otherwise pushed against the base while the other end of the spring is attached to or otherwise pushed against the spring follower. The open end of the magazine body is typically smaller than the follower so that the follower can move up and down within the magazine body but cannot exit the magazine body through the open end thereof. When in use, the magazine stores one or more rounds of ammunition cartridges therein with the ammunition cartridge(s) pushing down or otherwise compressing the spring via the spring follower. Moreover, the magazine moves the ammunition cartridge(s), one round at a time, into a position near or at the open end of the magazine body of the magazine where the ammunition cartridge can be loaded into a barrel chamber of the firearm by the action of the firearm.

In typical usage, the magazine requires manual manipulation of controls (e.g., by pressing a magazine release button) to release the magazine so that the magazine can be detached or otherwise removed from the firearm to facilitate reloading of new or additional ammunition cartridges into the magazine. In most applications, there may not be a readily apparent indicator of an emptied magazine. Undesirably, this may delay the user response and increase the time for reloading, which is detrimental to both combat and competitive applications. Furthermore, many platforms of firearms utilizing detachable box magazines, such as the AR15, are not ambidextrous in controls in that the magazine release is usually not as readily accessible by left handed users.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In one aspect, a magazine follower assembly implementable in a magazine of a firearm may include a casing and a self-releasing actuator received in the casing. When in use, the magazine follower assembly may generally move along a first axis with respect to the casing between a first position in the magazine, when the magazine is fully loaded, and a second position in the magazine, when the magazine contains no ammunition cartridge. When the magazine follower assembly is at the second position in the magazine, the self-releasing actuator may actuate a magazine release mechanism of the firearm to disengage the magazine from the firearm so that the magazine is detachable from the firearm.

In one aspect, a magazine attachable to a firearm may include a magazine follower assembly, a magazine spring, a base plate, and a magazine body in which the magazine follower assembly and the magazine spring are contained. The magazine body may be configured with a first distal end and a second distal end opposite the first distal end with the base plate sealing off the first distal end of the magazine body and the magazine spring disposed between the magazine follower assembly and the base plate so that one or more ammunition cartridges can be inserted into the magazine through the second distal end. The magazine follower assembly may generally move along a first axis with respect to the magazine between a first position in the magazine body, when the magazine is fully loaded with a plurality of ammunition cartridges, and a second position in the magazine body, when the magazine contains no ammunition cartridge. When the magazine follower assembly is at the second position in the magazine body, the magazine follower assembly may actuate a magazine release mechanism of the firearm to disengage the magazine from the firearm so that the magazine is detachable from the firearm.

It is noteworthy that, although examples provided in the present disclosure may be related to a certain type of firearms (e.g., AR15), various embodiments in accordance with the present disclosure may be adapted or otherwise implemented in different types of firearms. For instance, various embodiments in accordance with the present disclosure may be utilized with semiautomatic pistols, semiautomatic rifles, semiautomatic carbines, bolt-action rifles, as well as other types of firearms. Therefore, the scope of the present disclosure is not limited to examples provided herein.

BRIEF DESCRIPTION OF THE DRAWINGS

The accompanying drawings are included to provide a further understanding of the disclosure, and are incorporated in and constitute a part of the present disclosure. The drawings illustrate implementations of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED IMPLEMENTATIONS

Figure 1:
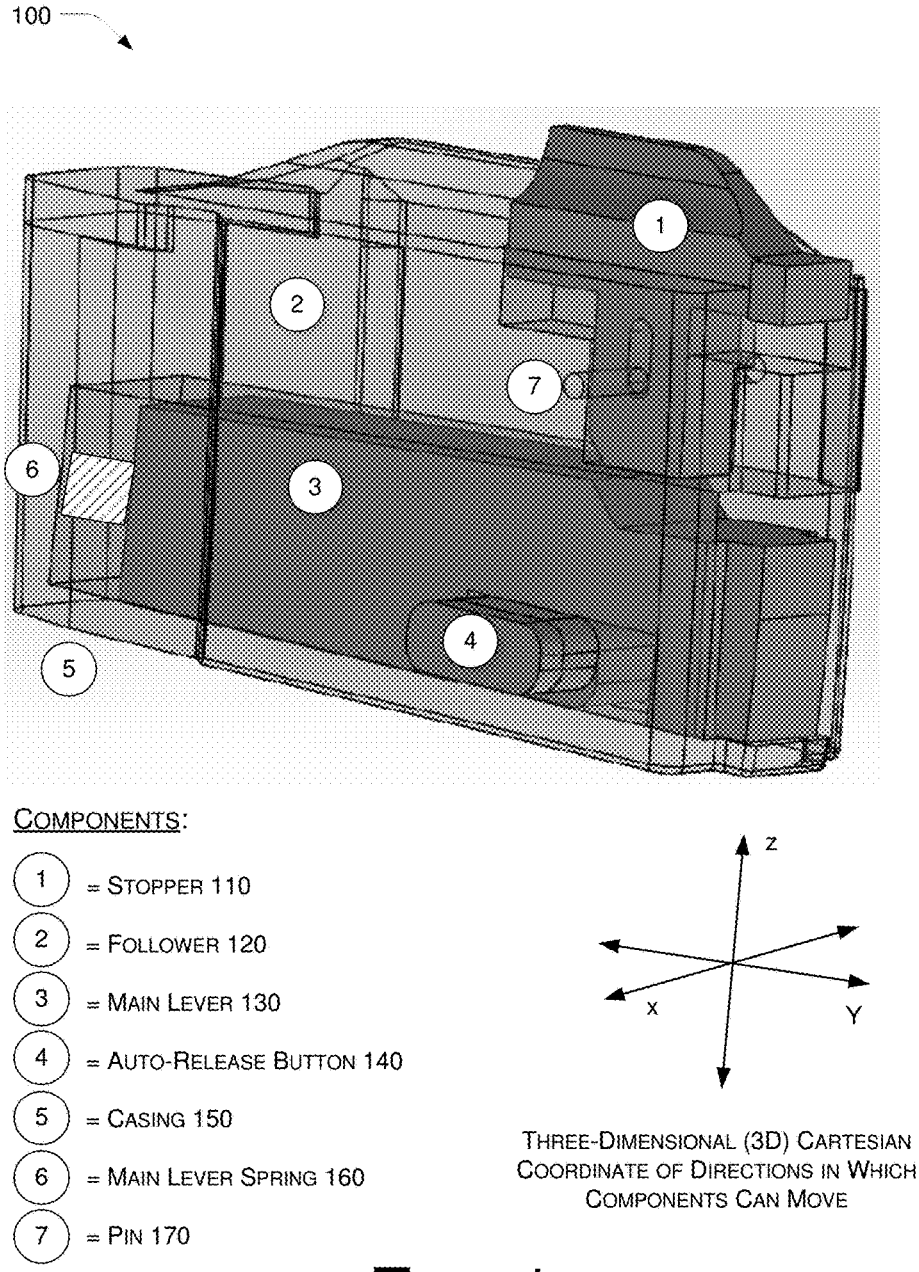
FIG. 1 is a diagram of a magazine follower assembly in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

Overview

The present disclosure provides a magazine follower assembly implementable in a magazine of a firearm. When the magazine is attached to the firearm and after a last round of ammunition cartridge is extracted from the chamber of the firearm, the magazine follower assembly may engage a magazine catch of a magazine release mechanism of the firearm (e.g., by either mechanical method or spring tension) to release the magazine automatically. The magazine follower assembly may utilize a mechanical actuator as means to engage the magazine catch of the firearm to automatically (without operator intervention) release the magazine so that the magazine becomes removable or otherwise detachable from the firearm (e.g., from the magazine well of an AR15).

In various implementations, the shape of the magazine follower assembly, as well as the exact means by which the actuator engages the magazine catch, may be dependent upon the host platform. That is, form factor and dimensions of the magazine follower assembly may vary depending on actual implementations (e.g., the firearm with which the magazine follower assembly is to be use). By utilizing the magazine follower assembly in accordance with the present disclosure, a self-releasing magazine may be fitted to any host platform that uses detachable box magazines. Moreover, with certain magazines, a conventional magazine follower in the magazine may be replaced by the magazine follower assembly in accordance with the present disclosure to convert the magazine into a self-releasing magazine. In other words, the magazine follower assembly may be adapted to the specific magazine of the host system. It is noteworthy that, although the detachable box magazine described herein may be an AR15 magazine, any number of other host systems that utilize a detachable box magazine may benefit from an adapted version of the magazine follower assembly in accordance with the present disclosure.

In various implementations, the magazine body and/or the magazine in which the magazine follower assembly in accordance with the present disclosure is utilized may have sufficient weight and freedom of movement to drop freely. This may allow the self-releasing magazine to drop from the firearm after the last round of ammunition cartridge is spent. Even when this is not the case, the magazine follower assembly in accordance with the present disclosure may still be used for automatically actuating the magazine release for the magazine to become removable or otherwise detachable without the need for the operator/user of the firearm to manually operate the magazine release. It is noteworthy that a self-releasing actuator or mechanism of the magazine follower assembly has sufficient force to engage the magazine catch of the host platform, which is typically under spring tension.

Illustrative Examples

FIG. 1 illustrates a magazine follower assembly 100 in accordance with an implementation of the present disclosure. Referring to FIG. 1, magazine follower assembly 100 may include a casing 150 and a self-releasing actuator received in casing 150. The self-releasing actuator may include a stopper 110, a main lever 130 and an auto-release button 140. The stopper 110 may be movable between a first position (e.g., a down position) and a second position (e.g., an up position) thereof relative to the casing 150 along a first axis (e.g., z-axis of a three-dimensional (3D) Cartesian coordinate system) with respect to the casing 150. The main lever 130 may be movable between a first position (e.g., a non-actuated position) and a second position (e.g., an actuated position) thereof relative to the casing 150 along a second axis (e.g., y-axis of the 3D Cartesian coordinate system) which is perpendicular to the first axis. The auto-release button 140 may be movable between a first position (e.g., a retracted position) and a second position (e.g., a protruded position) thereof relative to the casing 150 along a third axis (e.g., x-axis of the 3D Cartesian coordinate system) which is perpendicular to both the first axis and the second axis. Each component of the magazine follower assembly 100 may be made of plastic, metal, metal alloy, silicone, ceramic or another suitable type of material.

In some implementations, the stopper 110 may be configured with a sloped surface facing the main lever 130. Additionally, the auto-release button 140 may be configured with a sloped surface casing the main lever 130. Moreover, the main lever 130 may be configured with a first sloped surface facing the stopper 110 and in contact with the sloped surface of the stopper 110. Furthermore, the main lever 130 may be also configured with a second sloped surface facing the auto-release button 140 and in contact with the sloped surface of the auto-release button 140. Accordingly, when the main lever 130 moves from the first position to the second position thereof (e.g., from the non-actuated position to the actuated position), the first sloped surface of the main lever 130 may push the stopper 110 from the first position to the second position thereof (e.g., from the down position to the up position). Additionally, the second sloped surface of the main lever 130 may push the auto-release button 140 from the first position to the second position thereof (e.g., from the retracted position to the protruded position).

In some implementations, the self-releasing actuator may also include a pin 170 having a first end and a second end opposite the first end. The first end of the pin 170 may be mounted on the casing 150. The stopper 110 may be configured with a groove in which the second end of the pin 170 may be received. In some implementations, the groove may be configured to limit a linear movement of the stopper 110 to directions along the first axis (e.g., z-axis) with respect to the casing 150.

In some implementations, the self-releasing actuator may further include a main lever spring 160. The main lever spring 160 may be positioned or otherwise located in the self-releasing actuator such that, when at least one ammunition cartridge is loaded in the magazine in which the magazine follower assembly 100 is utilized, the at least one ammunition cartridge may exert a force on the stopper 110 along the first axis to cause the stopper 110 to exert a force on the main lever 130 along the second axis to move the main lever 130 to the second position thereof (e.g., the non-actuated position) to compress the main lever spring 160. Moreover, when no ammunition cartridge is contained in the magazine, the main lever spring 160 may exert a force on the main lever 130 to move from the first position to the second position thereof (e.g., from the non-actuated position to the actuated position) to cause the stopper 110 to move from the first position to the second position thereof (e.g., from the down position to the up position) and to cause the auto-release button 140 to move from the first position to the second position thereof (e.g., from the retracted position to the protruded position). The main lever spring 160 may be implemented by any elastic element. In some implementations, the main lever spring 160 may be a coil spring, a helical spring, a cantilever spring, a volute spring, a balance spring, a leaf spring, a V-spring, a wave spring or any other suitable type of spring.

In some implementations, the self-releasing actuator may also include a follower 120 which may be stationary relative to the casing 150. The follower 120 may be configured with a cavity in which the main lever 130 may be movably received. That is, the main lever 130 may slide within the cavity of the follower 120 between the first position and the second position thereof (e.g., between the non-actuated position and the actuated position). In some implementations, the main lever spring 160 may be disposed between the main lever 130 and the follower 120.

In some implementations, the casing 150 may be configured with a through hole. Accordingly, when at the second position thereof (e.g., the protruded position), the auto-release button 140 may protrude through the through hole of the casing 150, thereby actuating a magazine release mechanism of the firearm.

When in use, the magazine follower assembly 100 may generally move along the first axis with respect to the casing 150 between a first position in the magazine (e.g., a loaded position) when the magazine is fully loaded and a second position in the magazine (e.g., an unloaded position) when the magazine contains no ammunition cartridge. When the magazine follower assembly 100 is at the second position in the magazine (e.g., the unloaded position), the self-releasing actuator may actuate a magazine release mechanism of the firearm to disengage the magazine from the firearm so that the magazine is detachable from the firearm.

Figure 2:
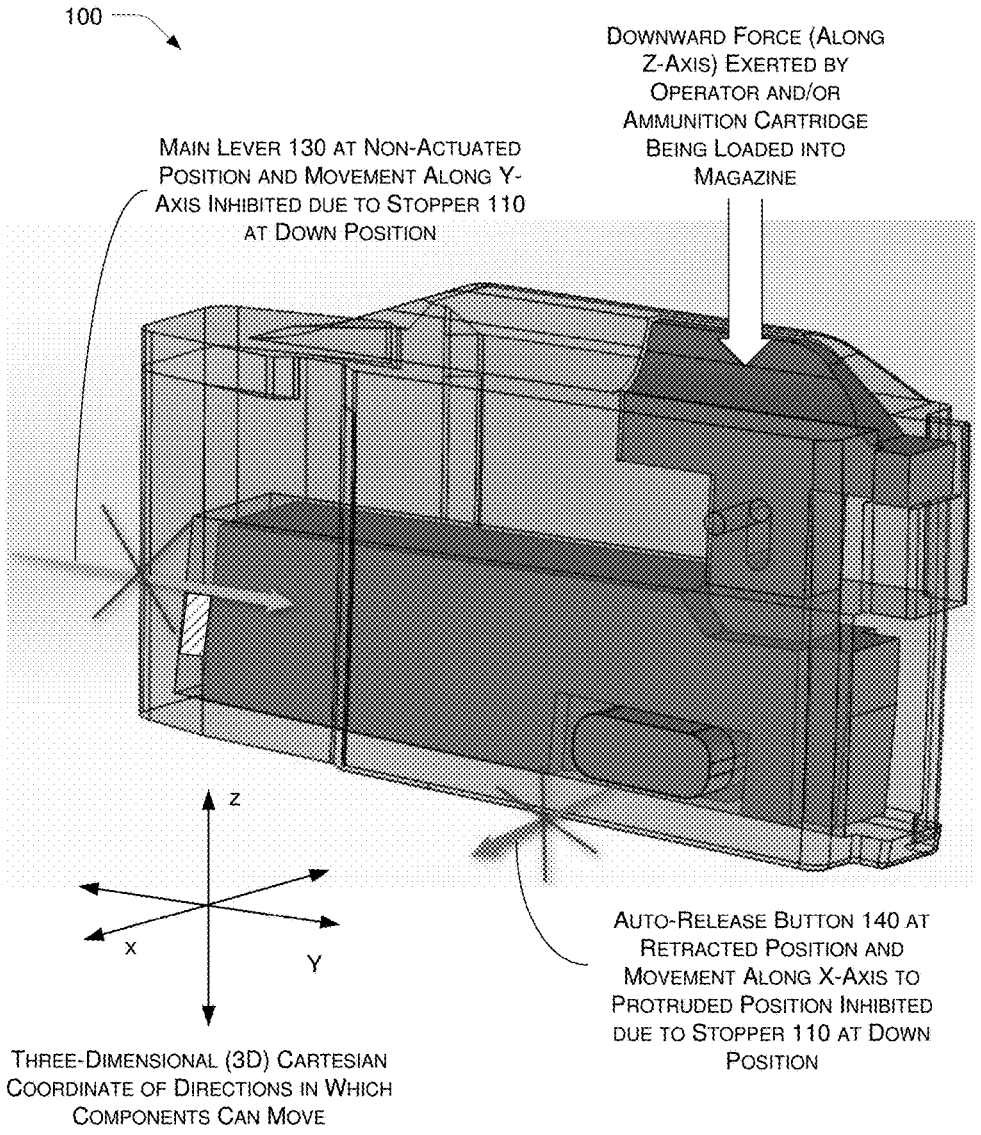
FIG. 2 is a diagram of the magazine follower assembly of FIG. 1 in a first state during operation in accordance with an implementation of the present disclosure.

FIG. 2 illustrates the magazine follower assembly 100 in a first state during operation in accordance with an implementation of the present disclosure. Referring to FIG. 2, when in the first state during operation, one or more ammunition cartridges may be loaded in the magazine in which the magazine follower assembly 100 is utilized. That is, a downward force (e.g., along the z-axis) may be exerted by the one or more ammunition cartridges (or operator of the firearm) onto the magazine follower assembly 100. Accordingly, the stopper 110 may be at the first position thereof (e.g., the down position), the main lever 130 may be at the first position thereof (e.g., the non-actuated position), and the auto-release button 140 may be at the first position thereof (e.g., the retracted position). Thus, in the first state (e.g., magazine loaded with ammunition cartridge(s)), the main lever spring 160 may be compressed, and the main lever 130 may be pushed to the first position thereof (e.g., the non-actuated position) by the stopper 110 which is in the first position thereof (e.g., the down position). Correspondingly, the auto-release button 140 is not pushed to its second position (e.g., the protruded position) when the magazine follower assembly 100 is in the first state.

Figure 3:
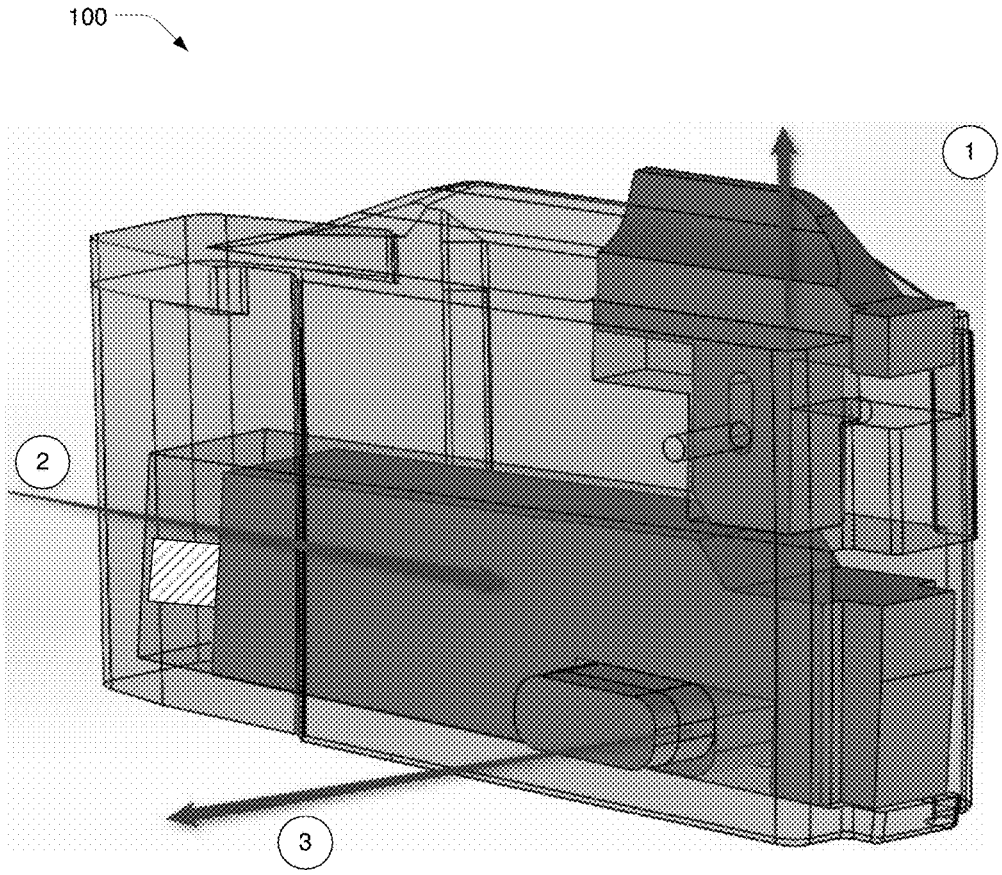
FIG. 3 is a diagram of the magazine follower assembly of FIG. 1 in a second state during operation in accordance with an implementation of the present disclosure.
Figure 3:
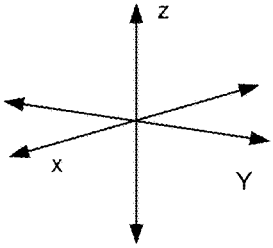

FIG. 3 illustrates magazine follower assembly 100 in a second state during operation in accordance with an implementation of the present disclosure. Referring to FIG. 3, when in the second state during operation, there is no ammunition cartridges loaded or otherwise held in the magazine in which the magazine follower assembly 100 is utilized. As no ammunition cartridge is contained in the magazine, there is no downward force exerted on the stopper 110. Accordingly, a number of actions take place. Firstly, the stopper 110 moves from its first position to its second position (e.g., from the down position to the up position) as a result of the main lever spring 160 exerting a force on the main lever 130 to push the main lever to its second position (e.g., the actuated position). Moreover, the main lever 130 may also push the auto-release button 140 from its first position to its second position (e.g., from the retracted position to the protruded position). As the auto-release button 140 moves to the protruded position, it may come in contact with and thus engage a magazine catch of a magazine release mechanism of the firearm, thereby releasing the magazine from the firearm.

Figure 4:
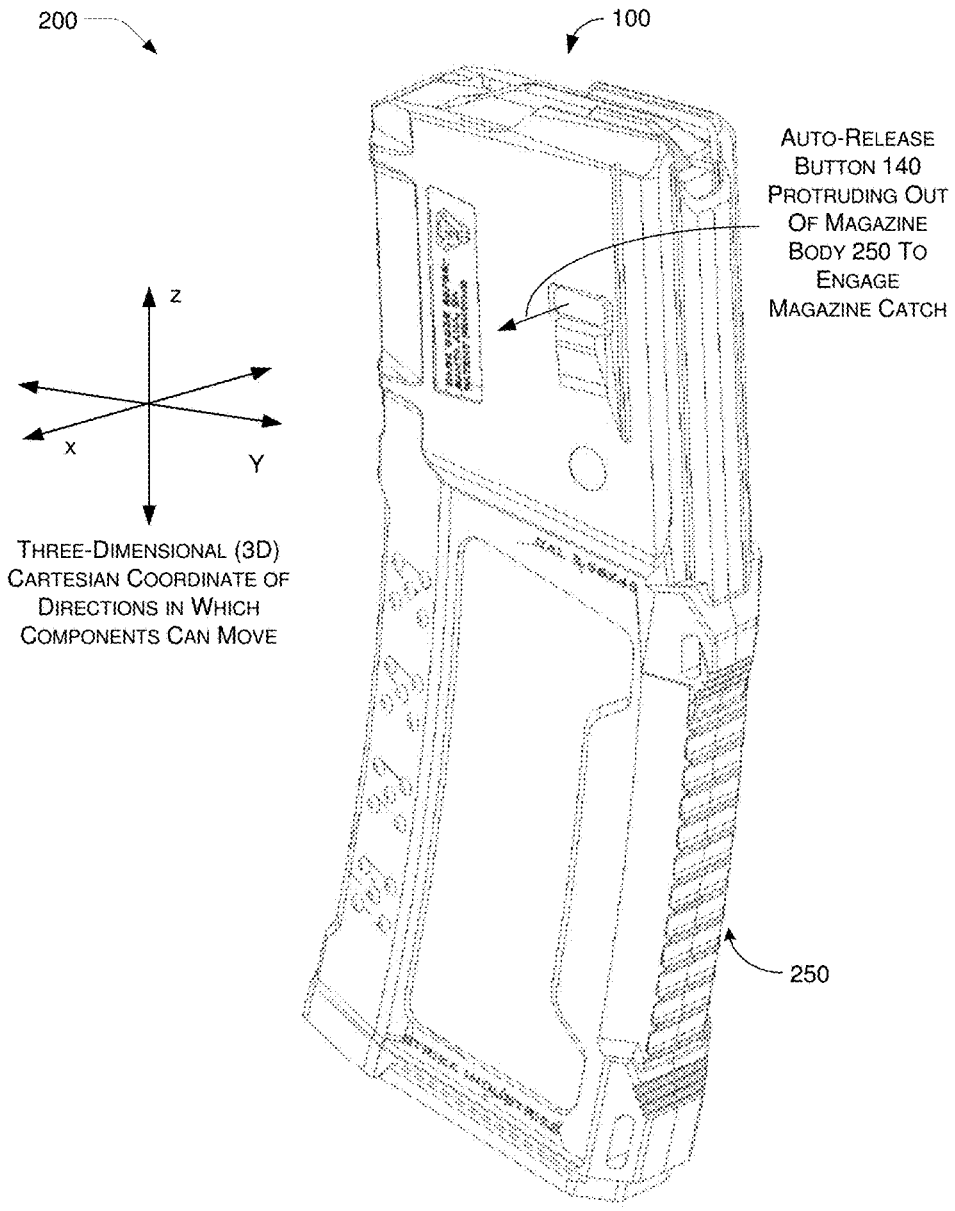
FIG. 4 is a diagram of a magazine utilizing the magazine follower assembly of FIG. 1 in accordance with an implementation of the present disclosure.

FIG. 4 illustrates a magazine 200 attachable to a firearm and utilizing magazine follower assembly 100 in accordance with an implementation of the present disclosure. Referring to FIG. 4, magazine 200 may include magazine follower assembly 100, a magazine spring (not shown), a base plate (not shown), and a magazine body 250 in which the magazine follower assembly 100 and the magazine spring are contained. The magazine body 250 may be configured with a first distal end (e.g., the lower end in FIG. 4) and a second distal end (e.g., the upper end in FIG. 4) opposite the first distal end. The base plate may seal off the first distal end of the magazine body 250, with the magazine spring disposed between the magazine follower assembly 100 and the base plate so that one or more ammunition cartridges can be inserted into the magazine body 250 through the second distal end. The magazine follower assembly 100 may generally move along a first axis (e.g., z-axis of the 3D Cartesian coordinate system) with respect to the magazine 200 between a first position (e.g., a loaded position) in the magazine body 250, when the magazine 200 is fully loaded with a plurality of ammunition cartridges, and a second position (e.g., an unloaded position) in the magazine body 250, when the magazine 200 contains no ammunition cartridge. Accordingly, when the magazine follower assembly 100 is at the second position in the magazine body 250, the magazine follower assembly 100 may actuate a magazine release mechanism of the firearm to disengage the magazine from the firearm so that the magazine 200 is removable or otherwise detachable from the firearm. For instance, the casing 150 of the magazine follower assembly 100 may include a first through hole, and the magazine body 250 may include a second through hole. Thus, when at the second position thereof (e.g., the protruded position), the auto-release button 140 may protrude through the first through hole of the casing 150 and the second through hole of the magazine body 250 to actuate the magazine catch of the magazine release mechanism of the firearm to disengage the magazine 200 from the firearm.

Highlight of Select Features

In one aspect, a magazine follower assembly implementable in a magazine of a firearm may include a casing and a self-releasing actuator received in the casing. When in use, the magazine follower assembly may generally move along a first axis with respect to the casing between a first position in the magazine when the magazine is fully loaded and a second position in the magazine when the magazine contains no ammunition cartridge. When the magazine follower assembly is at the second position in the magazine, the self-releasing actuator may actuate a magazine release mechanism of the firearm to disengage the magazine from the firearm so that the magazine is detachable from the firearm.

In some implementations, the self-releasing actuator may include a stopper, a main lever and an auto-release button. The stopper may be movable between a first position and a second position thereof relative to the casing along the first axis. The main lever may be movable between a first position and a second position thereof relative to the casing along a second axis perpendicular to the first axis. The auto-release button may be movable between a first position and a second position thereof relative to the casing along a third axis perpendicular to the first axis and the second axis. The casing may be configured with a through hole and, when at the second position thereof, the auto-release button may protrude through the through hole of the casing.

In some implementations, when at least one ammunition cartridge is loaded in the magazine, the stopper may be at the first position thereof, the main lever may be at the first position thereof, and the auto-release button may be at the first position thereof. When no ammunition cartridge is contained in the magazine, the stopper may be at the second position thereof, the main lever may be at the second position thereof, and the auto-release button may be at the second position thereof.

In some implementations, the self-releasing actuator may also include a main lever spring. In some implementations, when at least one ammunition cartridge is loaded in the magazine, the at least one ammunition cartridge may exert a force on the stopper along the first axis, causing the stopper to exert a force on the main lever along the second axis to move the main lever to the second position thereof to compress the main lever spring. When no ammunition cartridge is contained in the magazine, the main lever spring may exert a force on the main lever to move from the first position to the second position thereof, causing the stopper to move from the first position to the second position thereof and causing the auto-release button to move from the first position to the second position thereof.

In some implementations, the self-releasing actuator may further include a follower which may be stationary relative to the casing. The follower may be configured with a cavity in which the main lever is movably received. In some implementations, the main lever spring may be disposed between the main lever and the follower.

In some implementations, the stopper may be configured with a sloped surface facing the main lever, the auto-release button may be configured with a sloped surface casing the main lever, the main lever may be configured with a first sloped surface facing the stopper and in contact with the sloped surface of the stopper, and the main lever may be also configured with a second sloped surface facing the auto-release button and in contact with the sloped surface of the auto-release button. When the main lever moves from the first position to the second position thereof, the first sloped surface of the main lever may push the stopper from the first position to the second position thereof, and the second sloped surface of the main lever may push the auto-release button from the first position to the second position thereof.

In some implementations, the self-releasing actuator may additionally include a pin having a first end and a second end opposite the first end with the first end mounted on the casing. The stopper may be configured with a groove in which the second end of the pin is received. In some implementations, the groove may be configured to limit a linear movement of the stopper to directions along the first axis with respect to the casing.

In another aspect, a magazine attachable to a firearm may include a magazine follower assembly, a magazine spring, a base plate, and a magazine body in which the magazine follower assembly and the magazine spring may be contained. The magazine body may be configured with a first distal end and a second distal end opposite the first distal end with the base plate sealing off the first distal end of the magazine body. The magazine spring may be disposed between the magazine follower assembly and the base plate so that one or more ammunition cartridges can be inserted into the magazine body through the second distal end. The magazine follower assembly may generally move along a first axis with respect to the magazine between a first position in the magazine body when the magazine is fully loaded with a plurality of ammunition cartridges and a second position in the magazine body when the magazine contains no ammunition cartridge. When the magazine follower assembly is at the second position in the magazine body, the magazine follower assembly may actuate a magazine release mechanism of the firearm to disengage the magazine from the firearm so that the magazine is detachable from the firearm.

In some implementations, the magazine follower assembly may include a casing and a self-releasing actuator received in the casing. The self-releasing actuator may include a stopper, a main lever and an auto-release button. The stopper may be movable between a first position and a second position thereof relative to the casing along the first axis with respect to the casing. The main lever may be movable between a first position and a second position thereof relative to the casing along a second axis perpendicular to the first axis. The auto-release button may be movable between a first position and a second position thereof relative to the casing along a third axis perpendicular to the first axis and the second axis. The casing may be configured with a first through hole, and the magazine body may be configured with a second through hole. Accordingly, when at the second position thereof, the auto-release button may protrude through the first through hole of the casing and the second through hole of the magazine body to actuate the magazine release mechanism of the firearm to disengage the magazine from the firearm.

In some implementations, when at least one ammunition cartridge is loaded in the magazine, the stopper may be at the first position thereof, the main lever may be at the first position thereof, and the auto-release button may be at the first position thereof. When no ammunition cartridge is contained in the magazine, the stopper may be at the second position thereof, the main lever may be at the second position thereof, and the auto-release button may be at the second position thereof.

In some implementations, the self-releasing actuator may further include a main lever spring. In some implementations, when at least one ammunition cartridge is loaded in the magazine, the at least one ammunition cartridge may exert a force on the stopper along the first axis, causing the stopper to exert a force on the main lever along the second axis to move the main lever to the second position thereof to compress the main lever spring. When no ammunition cartridge is contained in the magazine, the main lever spring may exert a force on the main lever to move from the first position to the second position thereof, causing the stopper to move from the first position to the second position thereof and causing the auto-release button to move from the first position to the second position thereof.

In some implementations, the self-releasing actuator may additionally include a follower which may be stationary relative to the casing. The follower may be configured with a cavity in which the main lever is movably received. In some implementations, the main lever spring may be disposed between the main lever and the follower.

In some implementations, the stopper may be configured with a sloped surface facing the main lever, the auto-release button may be configured with a sloped surface casing the main lever, the main lever may be configured with a first sloped surface facing the stopper and in contact with the sloped surface of the stopper, and the main lever may be also configured with a second sloped surface facing the auto-release button and in contact with the sloped surface of the auto-release button. When the main lever moves from the first position to the second position thereof, the first sloped surface of the main lever may push the stopper from the first position to the second position thereof, and the second sloped surface of the main lever may push the auto-release button from the first position to the second position thereof.

In some implementations, the self-releasing actuator may also include a pin having a first end and a second end opposite the first end with the first end mounted on the casing. The stopper may be configured with a groove in which the second end of the pin is received. In some implementations, the groove may be configured to limit a linear movement of the stopper to directions along the first axis with respect to the magazine.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A magazine follower assembly implementable in a magazine of a firearm, comprising:

a casing; and a self-releasing actuator received in the casing, wherein, when in use, the magazine follower assembly generally moves along a first axis with respect to the casing between a first position in the magazine when the magazine is fully loaded and a second position in the magazine when the magazine contains no ammunition cartridge, and wherein, when the magazine follower assembly is at the second position in the magazine, the self-releasing actuator is configured to actuate a magazine release mechanism of the firearm to disengage the magazine from the firearm so that the magazine is detachable from the firearm.

2. The magazine follower assembly of claim 1, wherein the self-releasing actuator comprises:

a stopper movable between a first position and a second position thereof relative to the casing along the first axis;

a main lever movable between a first position and a second position thereof relative to the casing along a second axis perpendicular to the first axis; and an auto-release button movable between a first position and a second position thereof relative to the casing along a third axis perpendicular to the first axis and the second axis, wherein the casing comprises a through hole, and wherein, when at the second position thereof, the auto-release button protrudes through the through hole of the casing.

3. The magazine follower assembly of claim 2, wherein:

when at least one ammunition cartridge is loaded in the magazine, the stopper is at the first position thereof, the main lever is at the first position thereof, and the auto-release button is at the first position thereof, and when no ammunition cartridge is contained in the magazine, the stopper is at the second position thereof, the main lever is at the second position thereof, and the auto-release button is at the second position thereof.

4. The magazine follower assembly of claim 2, wherein the self-releasing actuator further comprises a main lever spring.

5. The magazine follower assembly of claim 4, wherein:

when at least one ammunition cartridge is loaded in the magazine, the at least one ammunition cartridge exerts a force on the stopper along the first axis, causing the stopper to exert a force on the main lever along the second axis to move the main lever to the second position thereof to compress the main lever spring, and when no ammunition cartridge is contained in the magazine, the main lever spring exerts a force on the main lever to move from the first position to the second position thereof, causing the stopper to move from the first position to the second position thereof and causing the auto-release button to move from the first position to the second position thereof.

6. The magazine follower assembly of claim 5, wherein the self-releasing actuator further comprises a follower which is stationary relative to the casing, and wherein the follower is configured with a cavity in which the main lever is movably received.

7. The magazine follower assembly of claim 6, wherein the main lever spring is disposed between the main lever and the follower.

8. The magazine follower assembly of claim 2, wherein:

the stopper is configured with a sloped surface facing the main lever;

the auto-release button is configured with a sloped surface casing the main lever;

the main lever is configured with a first sloped surface facing the stopper and in contact with the sloped surface of the stopper;

the main lever is also configured with a second sloped surface facing the auto-release button and in contact with the sloped surface of the auto-release button; and when the main lever moves from the first position to the second position thereof, the first sloped surface of the main lever pushes the stopper from the first position to the second position thereof, and the second sloped surface of the main lever pushes the auto-release button from the first position to the second position thereof.

9. The magazine follower assembly of claim 2, wherein the self-releasing actuator further comprises a pin having a first end and a second end opposite the first end with the first end mounted on the casing, and wherein the stopper is configured with a groove in which the second end of the pin is received.

10. The magazine follower assembly of claim 9, wherein the groove is configured to limit a linear movement of the stopper to directions along the first axis with respect to the casing.

11. A magazine attachable to a firearm, comprising:

a magazine follower assembly;

a magazine spring;

a base plate; and a magazine body in which the magazine follower assembly and the magazine spring are contained, the magazine body configured with a first distal end and a second distal end opposite the first distal end with the base plate sealing off the first distal end of the magazine body and the magazine spring disposed between the magazine follower assembly and the base plate so that one or more ammunition cartridges can be inserted into the magazine body through the second distal end, wherein the magazine follower assembly generally moves along a first axis with respect to the magazine between a first position in the magazine body when the magazine is fully loaded with a plurality of ammunition cartridges and a second position in the magazine body when the magazine contains no ammunition cartridge, and wherein, when the magazine follower assembly is at the second position in the magazine body, the magazine follower assembly is configured to actuate a magazine release mechanism of the firearm to disengage the magazine from the firearm so that the magazine is detachable from the firearm.

12. The magazine of claim 11, wherein the magazine follower assembly comprises a casing and a self-releasing actuator received in the casing, and wherein the self-releasing actuator comprises:

a stopper movable between a first position and a second position thereof relative to the casing along the first axis with respect to the casing;

a main lever movable between a first position and a second position thereof relative to the casing along a second axis perpendicular to the first axis; and an auto-release button movable between a first position and a second position thereof relative to the casing along a third axis perpendicular to the first axis and the second axis, wherein the casing comprises a first through hole, wherein the magazine body comprises a second through hole, and wherein, when at the second position thereof, the auto-release button protrudes through the first through hole of the casing and the second through hole of the magazine body to actuate the magazine release mechanism of the firearm to disengage the magazine from the firearm.

13. The magazine of claim 12, wherein:

when at least one ammunition cartridge is loaded in the magazine, the stopper is at the first position thereof, the main lever is at the first position thereof, and the auto-release button is at the first position thereof, and when no ammunition cartridge is contained in the magazine, the stopper is at the second position thereof, the main lever is at the second position thereof, and the auto-release button is at the second position thereof.

14. The magazine of claim 12, wherein the self-releasing actuator further comprises a main lever spring.

15. The magazine of claim 14, wherein:

when at least one ammunition cartridge is loaded in the magazine, the at least one ammunition cartridge exerts a force on the stopper along the first axis, causing the stopper to exert a force on the main lever along the second axis to move the main lever to the second position thereof to compress the main lever spring, and when no ammunition cartridge is contained in the magazine, the main lever spring exerts a force on the main lever to move from the first position to the second position thereof, causing the stopper to move from the first position to the second position thereof and causing the auto-release button to move from the first position to the second position thereof.

16. The magazine of claim 15, wherein the self-releasing actuator further comprises a follower which is stationary relative to the casing, and wherein the follower is configured with a cavity in which the main lever is movably received.

17. The magazine of claim 16, wherein the main lever spring is disposed between the main lever and the follower.

18. The magazine of claim 12, wherein:

the stopper is configured with a sloped surface facing the main lever;

the auto-release button is configured with a sloped surface casing the main lever;

the main lever is configured with a first sloped surface facing the stopper and in contact with the sloped surface of the stopper;

the main lever is also configured with a second sloped surface facing the auto-release button and in contact with the sloped surface of the auto-release button; and when the main lever moves from the first position to the second position thereof, the first sloped surface of the main lever pushes the stopper from the first position to the second position thereof, and the second sloped surface of the main lever pushes the auto-release button from the first position to the second position thereof.

19. The magazine of claim 12, wherein the self-releasing actuator further comprises a pin having a first end and a second end opposite the first end with the first end mounted on the casing, and wherein the stopper is configured with a groove in which the second end of the pin is received.

20. The magazine of claim 19, wherein the groove is configured to limit a linear movement of the stopper to directions along the first axis with respect to the magazine.

* * * * *